US005687426A

United States Patent [19]

Sperber

[11] Patent Number: 5,687,426

[45] Date of Patent: Nov. 18, 1997

[54] BICYCLE HELMET

[75] Inventor: Gerhard Sperber, Hersbruck, Germany

[73] Assignee: Elasto Form, Sulzbach-Rosenberg, Germany

[21] Appl. No.: 704,172

[22] Filed: Aug. 28, 1996

Related U.S. Application Data

[63] Continuation of Ser. No. 570,826, Dec. 12, 1995, abandoned, which is a continuation of Ser. No. 121,921, Sep. 17, 1993, abandoned.

[30] Foreign Application Priority Data

| | | | |
|---|---|---|---|
| Feb. 25, 1993 | [DE] | Germany | 43 05 745.4 |
| Aug. 9, 1993 | [DE] | Germany | 43 26 667.3 |
| Aug. 9, 1993 | [DE] | Germany | 9311851 U |
| Aug. 31, 1993 | [DE] | Germany | 43 29 297.6 |

[51] Int. Cl.[6] ..... A42B 3/00

[52] U.S. Cl. ..... 2/411; 2/413; 2/425

[58] Field of Search ..... 2/410, 411, 412, 2/413, 414, 424, 425, 421, 422, 6.8

[56] References Cited

U.S. PATENT DOCUMENTS

| | | | |
|---|---|---|---|
| 2,354,840 | 8/1944 | Seletz | 2/410 X |
| 2,618,780 | 11/1952 | Cushman | 2/413 |
| 2,664,567 | 1/1954 | Nichols | 2/413 |
| 3,425,061 | 2/1969 | Webb . | |
| 3,770,483 | 11/1973 | Komine . | |
| 3,787,893 | 1/1974 | Larcher | 2/413 |
| 3,813,696 | 6/1974 | Yeager . | |
| 3,857,934 | 12/1974 | Bernstein et al. | 424/30 |
| 3,872,511 | 3/1975 | Nichols . | |
| 3,877,076 | 4/1975 | Summers et al. . | |
| 3,999,220 | 12/1976 | Keltner . | |
| 4,075,717 | 2/1978 | Lemelson . | |
| 4,124,904 | 11/1978 | Matthes . | |
| 4,599,752 | 7/1986 | Mitchell | 2/425 |
| 4,845,786 | 7/1989 | Chiarella | 2/412 |
| 5,023,117 | 6/1991 | Stephens . | |
| 5,204,998 | 4/1993 | Liu | 2/411 |
| 5,259,071 | 11/1993 | Scott et al. | 2/410 X |

FOREIGN PATENT DOCUMENTS

| | | | |
|---|---|---|---|
| 544241 | 5/1985 | Australia . | |
| 235033 | 8/1964 | Austria | 2/410 |
| 517091 | 12/1992 | European Pat. Off. | 2/411 |
| 2387611 | 11/1978 | France . | |
| 2614892 | 10/1977 | Germany . | |
| 3344706 | 6/1985 | Germany . | |
| 3530396 | 2/1987 | Germany . | |
| 8715461 | 5/1988 | Germany . | |
| 487643 | 6/1938 | United Kingdom . | |
| 945412 | 12/1963 | United Kingdom . | |
| 1578351 | 11/1980 | United Kingdom . | |

*Primary Examiner*—Michael A. Neas

*Attorney, Agent, or Firm*—Merchant, Gould, Smith, Edell, Welter & Schmidt, P.A.

[57] ABSTRACT

A bicycle helmet including a pair of spaced synthetic plastic shells and contains an opening having an annular wall surface connecting the shells, the annular wall being successively axially convergent and divergent, thereby to reinforce the helmet, and to afford circulation of air to the user's head.

17 Claims, 8 Drawing Sheets

BICYCLE HELMET

This is a File Wrapper Continuation of application Ser. No. 08/570,826, filed Dec. 12, 1995 now abandoned, which is a File Wrapper Continuation application of Ser. No. 08/121,921 filed Sep. 17, 1993, now abandoned.

STATEMENT OF THE INVENTION

A bicycle crash helmet of double-walled construction includes a pair of spaced synthetic plastic shells, said helmet containing at least one through opening that extends between the shells and has an annular side wall that successively converges and diverges axially of the opening, thereby to reinforce the shell and afford circulation of air to the head of the user.

BRIEF DESCRIPTION OF THE PRIOR ART

The invention relates to a helmet, particularly a bicycle crash helmet of plastic. In this context it is known that the bicycle crash helmets are made from deep-drawn plastic or a foamed plastic. In both cases, manufacturing costs are extremely high and thus have a negative effect on the practical use of such bicycle crash helmets that are actually very desirable and necessary for safety reasons. Furthermore, bicycle crash helmets of deep-drawn plastic have the disadvantage that they are relatively heavy. Bicycle crash helmets of foamed plastic can only be foamed in certain colors. A complete disposal of the helmets also is not always ensured according to the present state of the art.

Another disadvantage of known bicycle crash helmets is that they may be irreparably damaged (tears, breaks, etc.) during a fall, and the stability of the bicycle crash helmet is deteriorated. This makes it necessary to dispose of the bicycle crash helmets and replace them with new bicycle crash helmets.

In this context, there is also the danger that tears in the bicycle crash helmet consisting of foamed polystyrene are not immediately detected by the user, resulting in risks when the helmet is used.

SUMMARY OF THE INVENTION

The primary object of the invention was therefore to first create a helmet, particularly of plastic, that can be manufactured at lower manufacturing costs than prior art plastic helmets, but where the resistance to stresses, e.g. during a fall, shall not be affected negatively.

This task is first solved in a helmet of plastic that is double-walled. The double-wall construction combines the advantage of a high resistance and especially an absorption effect due to the enclosed air to the forces that must be absorbed by the helmet during a fall with the further advantage of the very low weight of this helmet.

The above advantages are synergically supported by the characteristic of the double wall consisting of a blown plastic. On the one hand, this results in a significant reduction in manufacturing costs since the helmet can be made in a single shaping process, and on the other hand, although a blown plastic is elastic, it has however a certain hardness and is therefore especially suitable e.g. for a bicycle crash helmet. Finally, the blown plastic may have a relatively thin wall thickness, something that significantly contributes to the desired reduction in weight. In contrast to foamed helmets (e.g. of foamed polystyrene), the helmet according to the present invention can easily be returned to its starting shape in the case of a lasting deformation, namely by heating the deformed point with hot water or a blow dryer, etc. Said dents then "snap" back to their original shape. In contrast to standard bicycle crash helmets of foamed polystyrene, damages in the new helmet are immediately visible and are unable to increase the user's risk of such a bicycle crash helmet. It is also possible that the helmet can be colored in any color the clients desire, something which so far was not possible when foamed polystyrene was used. It is even possible to add odorous substances to the plastic, thus increasing the marketing effect or sales of such helmets, e.g. in the case of special helmets for children.

The one-part construction of the helmet has the advantage that the helmet shell can be manufactured in a single manufacturing step, so that it is no longer necessary to perform installation or adhesion steps. There is also no longer the risk that glued points come apart when the helmet is subjected to mechanical or thermal stresses.

The multi-shell construction of the helmet according to the invention offers the advantage that the hollow chamber—if so desired—can be filled or lined with special absorption material, something which may be of importance for certain applications or for a certain absorption material itself that cannot be injected or foamed in.

To increase the deformation resistance of the helmet or bicycle crash helmet according to the invention, means are provided that cause a reinforcement of the walls of the helmet under pressure stress and also when the helmet is contorted. This double wall construction thus creates a helmet that completely fulfills the technical requirements regarding stability and in addition far surpasses the properties of standard helmets (bicycle crash helmets) made e.g. from foamed polystyrene.

The reinforcement offers the advantage that, if a user falls and the head protected by the helmet hits a hard object, road surface, etc., the invented helmet is able to absorb a greater impact energy than a helmet that has no reinforcements. With the latter, it may be the case that the two helmet walls touch each other at the impact point even in the case of a slight impact, and the impact energy still present acts on the head of the driver without prior absorption.

It is useful that the reinforcement means consist of at least one through opening the walls of which are closed in themselves, i.e. bring about a connection between outside wall and inside wall in the area of the openings. The walls of the openings result in a reinforcement of the helmet walls relative to each other and thus in an increased suitability for impact absorption. This design has the additional advantage that it offers the possibility of producing or at least preparing the openings during the blowing process in a one-part helmet. It is useful that the two walls are molded to each other in the area of the opening and are then cut out, thus creating the corresponding openings. In addition to the reinforcing effect, the openings have the added advantage that they ensure air circulation between the user's head and the helmet inside.

It is useful that for this purpose several openings are provided and are constructed longitudinally and oriented in the longitudinal direction of the helmet.

The helmet has both manufacturing-technical advantages, and also causes a certain impact absorption behavior in the area of the openings due to the walls that have been a generally V-shaped cross-sectional configuration and have constructed so as to axially extend successively convergingly and divergingly.

It is useful to furthermore provide ribs at the outside and/or inside walls in order to increase the rigidity of the helmet more.

Other measures that increase the rigidity of the helmet are described in provided, thereby making. This makes it possible to easily fulfill the respective domestic and foreign legal regulations or standards.

It is possible that inside the hollow chamber formed by the two walls a certain distance A may exist between facing walls, thus facilitating the manufacturing of the helmet using the blowing process.

It is also possible to foam out the hollow chamber between the two walls with a suitable material, especially plastic, in order to reinforce or increase the absorption effect.

As an alternative, it is possible that the hollow chamber, especially in the case of a two-part design of the helmet, is filled with particles of foamed plastic as an additional shock absorber. This makes it possible to manufacture the entire helmet from recycable material.

To increase the shock absorption, an alternative design of the invention provides that the entire hollow chamber is subject to an overpressure.

Other useful designs are provided for increasing the shock absorption property of the helmet according to the invention.

Because of the double wall construction of the invented helmet, the hardness and/or wall thickness of the plastic can be adapted to the helmet dimensions and/or the desired impact resistance.

Due to the manufacturing of the helmet using the blowing process, it is possible that the plastic material itself contains luminescent, fluorescent dyes or color pigments. In prior art foamed polystyrene helmets, this had to be realized with a foil that had to be additionally applied to the foamed polystyrene helmet. The same is true for the use of plastic material which in the case of the invention even may be equipped with odorous substances, so that especially in the case of children's bicycle crash helmets a special "marketing gag" is made possible.

In order to avoid injuries to the user through an impact of the helmet onto the nose edge during a fall, the front side of the helmet facing the face of the user has a recess in the center, thus reducing the edge effect of the front side of the helmet.

It is useful that in the area of the break-throughs fan wheels are provided that ensure an increased aeration of the break-throughs. The fan wheels can be driven both by the driving wind or even by a solar cell that is located e.g. at the outside of the outside wall of the helmet.

Additional designs of the invention using especially designed air outlet openings for influencing the absorption behavior of the helmet.

The invention furthermore relates to a crash helmet, particularly a motor cycle helmet that is characterized in that it comprises a helmet of basic structure which basic structure carries at its outside an additional helmet shell in a rigid connection. Standard crash helmets of foamed polystyrene are thus replaced with the new basic structure of plastic and with double wall construction.

The invention also relates to a process for manufacturing a helmet, particularly a bicycle crash helmet, that is characterized in that the helmet is blown inside a mold from a plastic tube in such a way that the tube is shaped inside a hollow chamber of the form into a double wall forming the helmet. This makes it possible to manufacture such a helmet in an especially simple manner, whereby simultaneously all advantages of the plastic used for this purpose can be transferred to the helmet production.

It is particularly advantageous that with the blowing process it is simultaneously possible to also incorporate the reinforcements in the form of wall areas into the helmet, whereby said areas are in contact with each other and are then cut out, thus creating break-throughs that both reinforce and aerate the helmet.

BRIEF DESCRIPTION OF THE DRAWINGS

Useful designs of the invention are described with reference to the accompanying drawings, in which.

DETAILED DESCRIPTION

Figure 1:
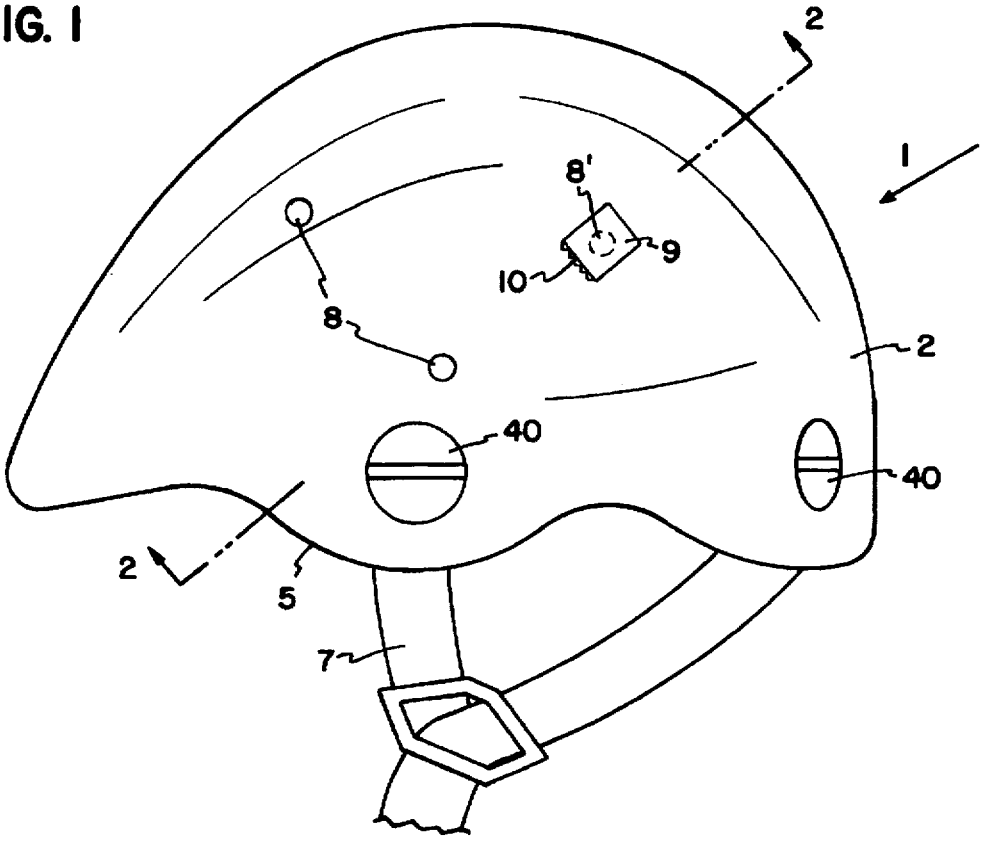
FIG. 1 is a side elevational view of a bicycle crash helmet according to the invention.
Figure 2:
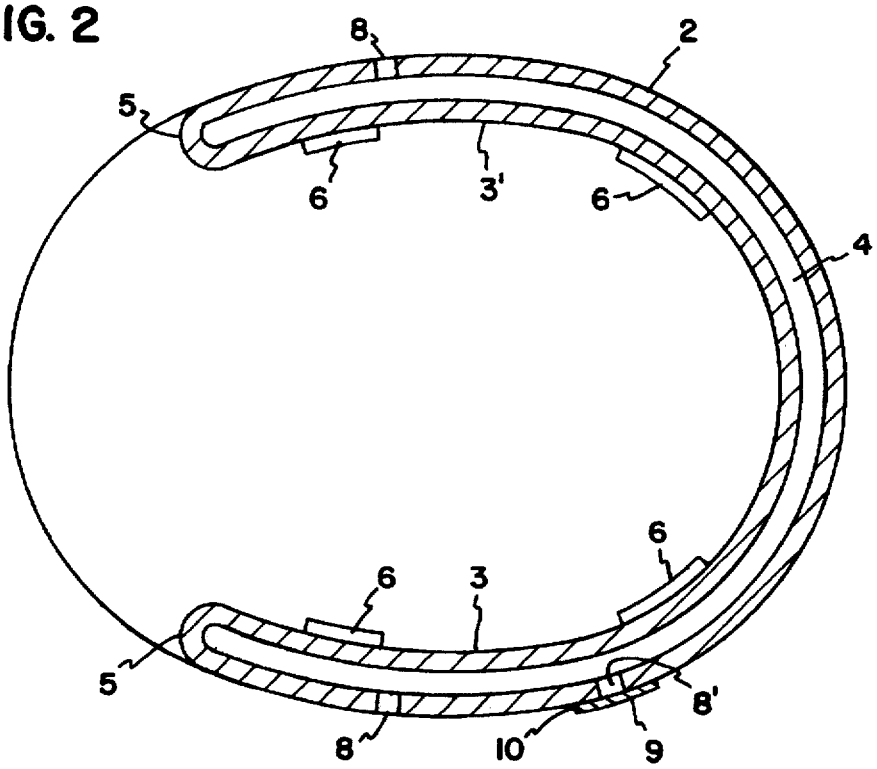
FIG. 2 is a section along line 2—2 of FIG. 1.

The helmet, here bicycle crash helmet 1, is—as shown in FIG. 2—double-walled, i.e., it consists of an outside wall 2 and an inside wall 3 that in itself define a closed hollow chamber 4 on both sides. At their front faces 5, the walls 2, 3 merge into each other so as to seal the hollow chamber 4 there towards the outside. The walls 2, 3 with their front faces 5 are thus a one-part element forming the bicycle crash helmet 1, consisting of an appropriate synthetic plastic material, preferably polyethylene.

Standard absorption strips of foamed plastic or rubber and the standard chin straps 7 can be attached to surface 3' of inside wall 3. For this purpose, openings (not shown) transcending both walls 2, 3 may be present, into which the molded parts 40 carrying the chin straps 7 are inserted, whereby a safe connection is realized by clamping, slot-spring connection, etc.

It is useful that the hollow chamber 4 is connected to outside air via small air passage openings. In addition or instead of these openings 8, it is also possible that openings 8' with a larger diameter are provided that are closed off with an overpressure valve, preferably a valve 9 attached to the outside. In the case of a shock, the impact force results in a pressure on both wall parts 2, 3 in the direction towards the hollow chamber 4. This is especially true for outside wall 2. This compresses the volume of the hollow chamber 4. To achieve a desired, elastic resilience of the crash helmet, it is advantageous that the air present in the hollow chamber 4 is able to escape through openings 8, 8' to the outside. Hereby a certain slowing of the air discharge may be found to be advantageous. In the case of the examples of openings 8, this is achieved by a correspondingly lower diameter of the openings, and in the example of openings 8' by a plastic or rubber flap that presses with its inherent elastic force from outside against opening 8', whereby this elastic force also can be overcome by the air that streams out.

The flap 9 is attached at the cutting line 10 of the outside of the helmet 1. Other such arrangements are also feasible.

Figure 3:
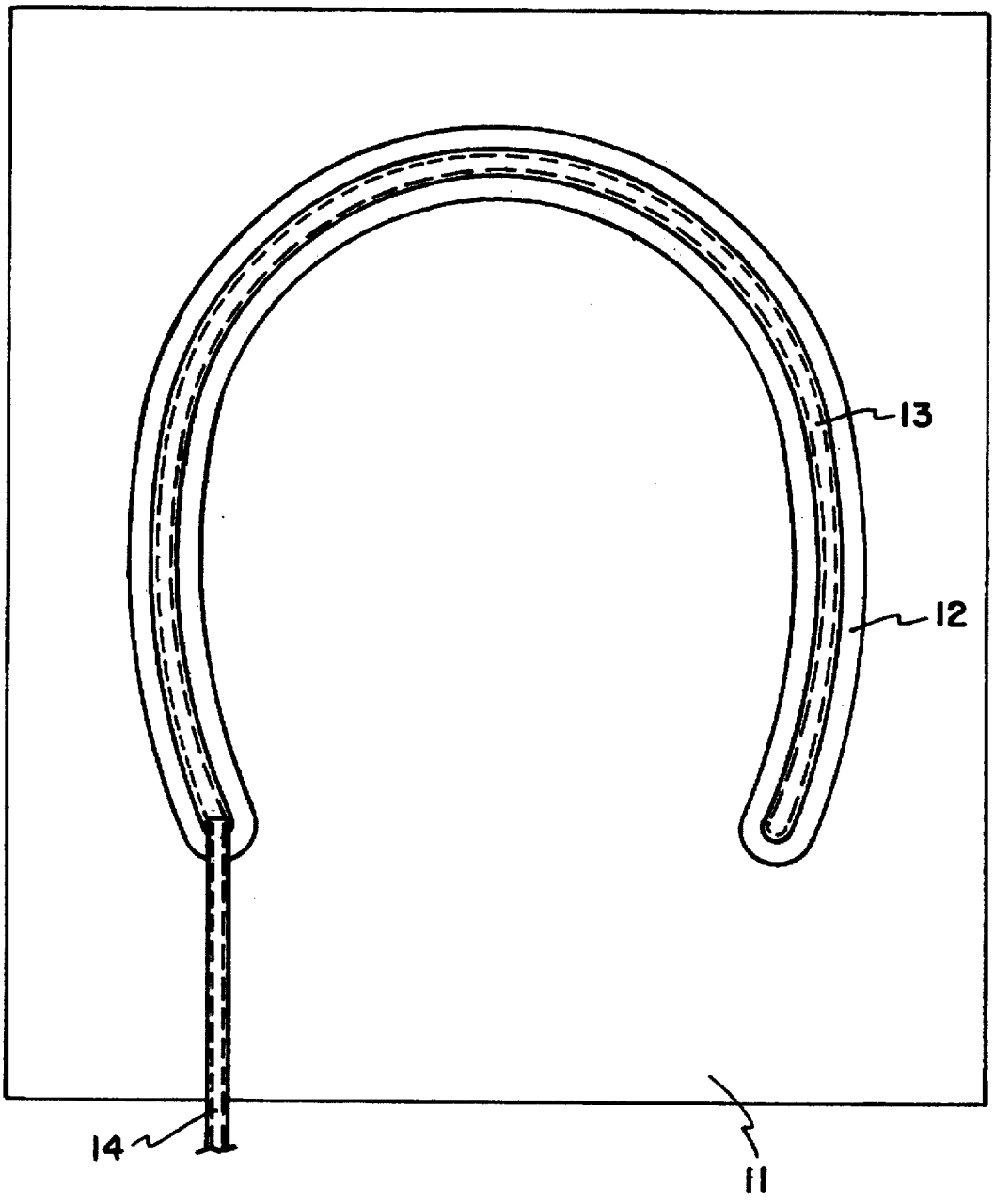
FIG. 3 is a section through a mold with inserted tube to be blown into a double wall bicycle crash helmet.

FIG. 3 shows a totally schematic illustration of the blowing of such a crash helmet using a mold 11 that has a recess 12 corresponding to the external dimensions of the crash helmet to be manufactured. Into this recess 12 or opening is inserted a tube 13 that is blown up via an air conduit 14 and is hardened in the desired manner using heat.

It is also important in this manufacturing process that attachment slots for the chin straps 7 can be advantageously incorporated into the blown plastic. They have a higher resistance to tearing than bicycle crash helmets manufactured from foamed plastic (e.g. foamed polystyrene) or by deep-drawing.

It is particularly possible to use a recycable plastic, e.g. polyethylene, polypropylene, copolymer, polystyrene copolymer, acryl-butadiene-styrene, ABS, polyamide PET (polyethylene-terephthalate), or polycarbonate to manufacture the bicycle crash helmet. Wall thickness, elasticity, and hardness of the plastic can be adjusted according to the desired requirements.

The hollow chamber between the two walls 2, 3 can be filled with a foamed plastic. This may be realized either by foaming or by filling in, e.g., small spheres of foamed plastic.

Figure 4:
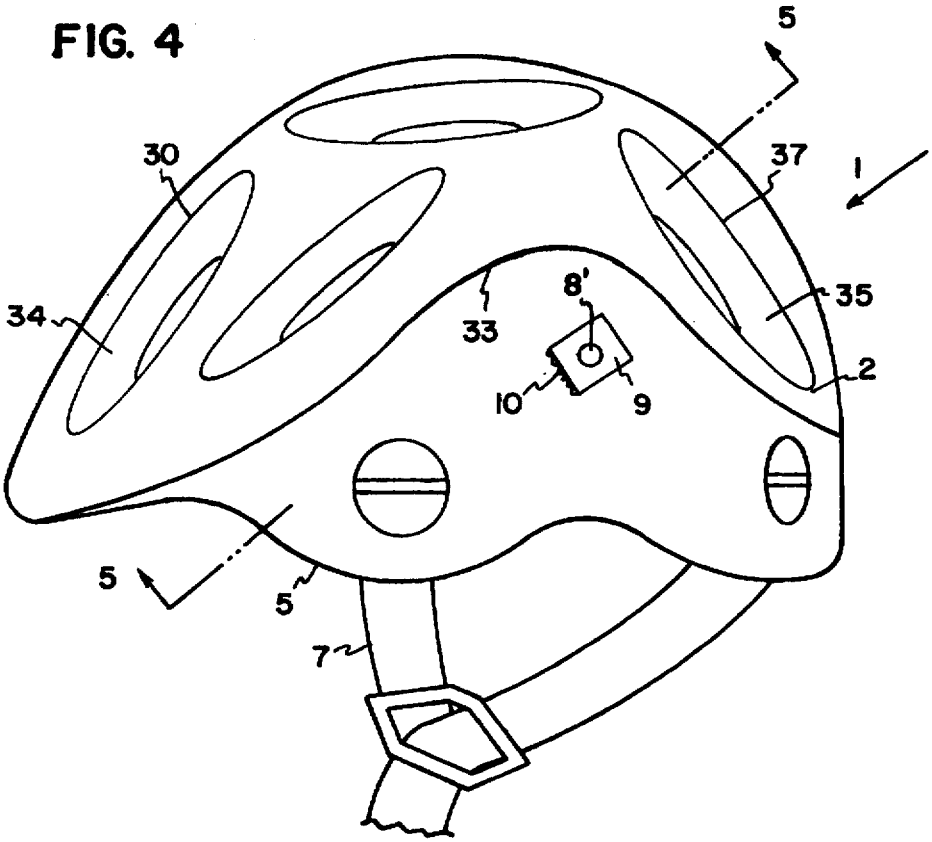
FIG. 4 is a side elevational view of another design of the bicycle crash helmet according to the invention.

FIG. 4 shows another design of the invented bicycle crash helmet with openings 30, 31 arranged at the top side that cause an increase in rigidity between the two walls 2, 3 during pressure stress and thus significantly improve the ability of the bicycle crash helmet 1 to absorb shock energy.

The individual openings 30, 31 have side walls 34, 35, respectively that connect the outside wall 2 to the inside wall 3, so that the remaining hollow chamber 4 remains closed in itself.

Figure 5:
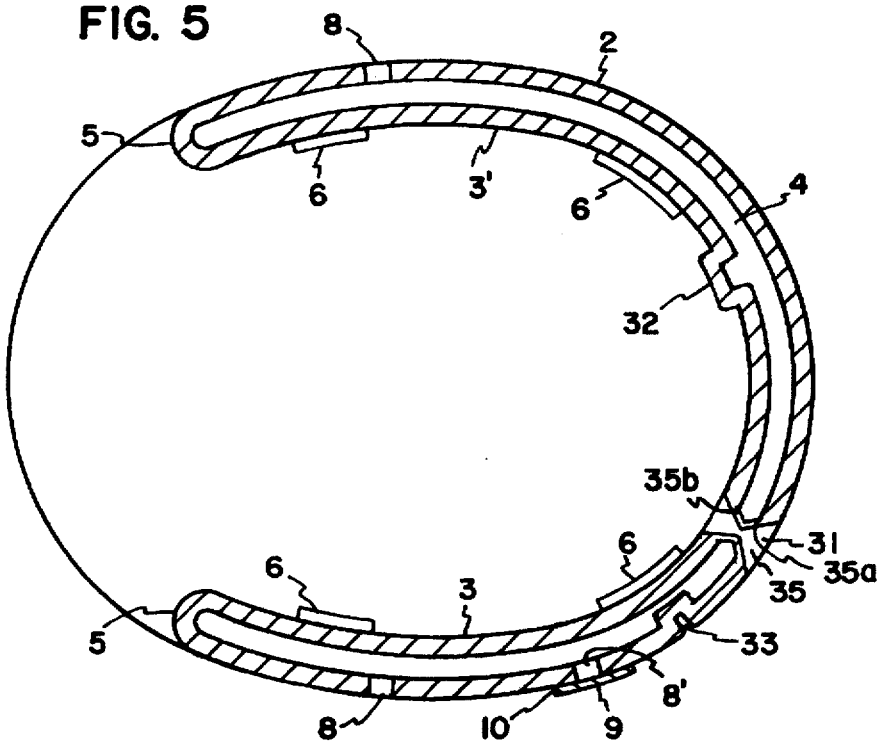
FIG. 5 is a section along line 5—5 of FIG. 4.
Figure 6:
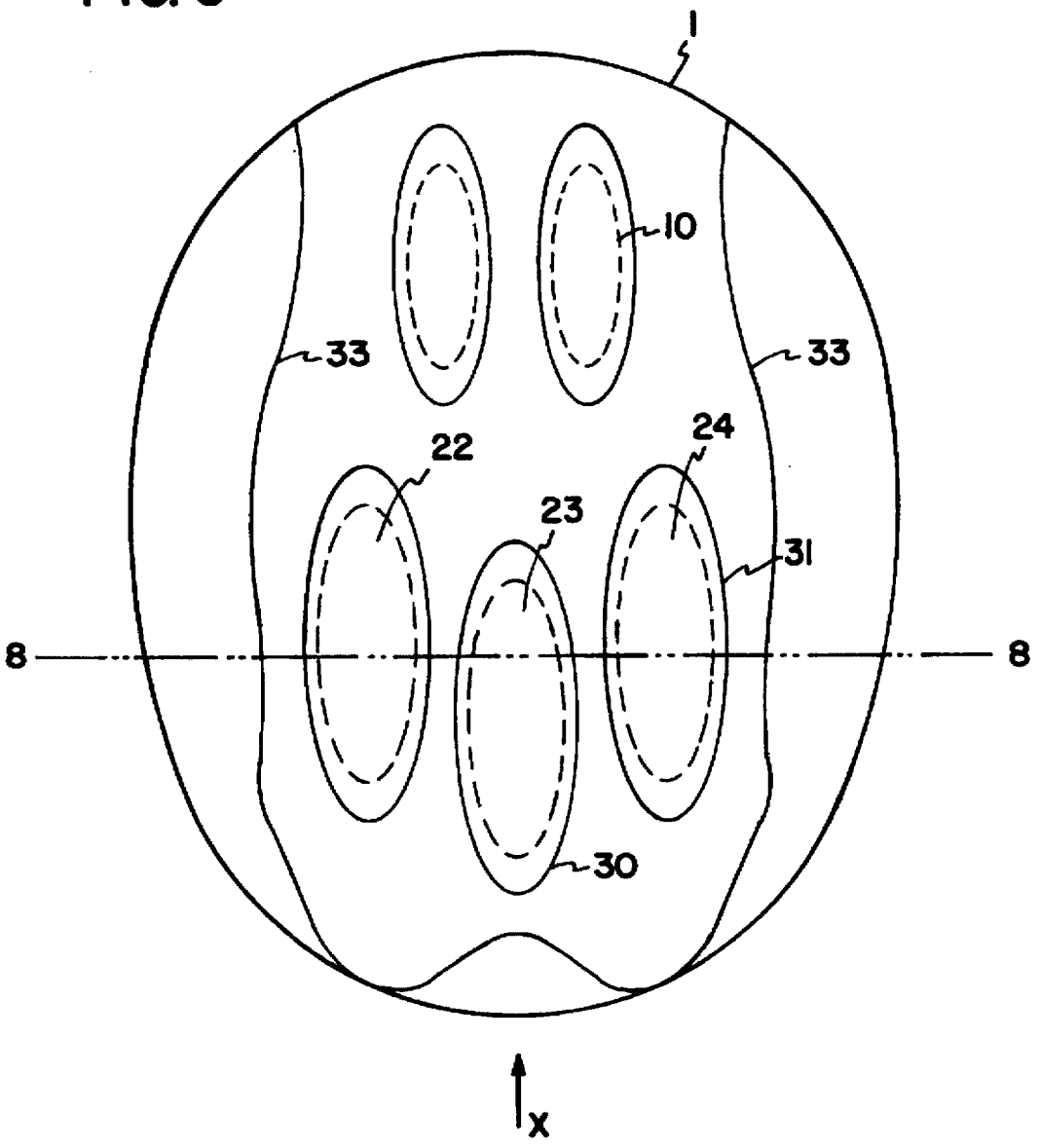
FIG. 6 is a top view of the front part of the helmet according to the bicycle crash helmet in FIG. 4.

As shown in FIG. 5, the side wall 35 of opening 31 includes, in the direction extending axially inwardly from the outer shell 2 to the inner shell 3, successive integral convergent and divergent wall portions 35*a* and 35*b*, respectively. An arcuate rib 33 on the outer shell 2 extends from the front of the helmet toward the side of the bicycle crash helmet 1 for further reinforcement of the bicycle crash helmet 1. In addition to the effect that increases the rigidity, this ensures an especially good aeration of the head area of the user of such a bicycle crash helmet 1. FIG. 6 furthermore shows that the individual openings, e.g. 30, 31, are disposed offset to each other, improving the rigidity profile of the bicycle crash helmet 1 yet more.

FIG. 6 also shows the laterally attached rib 33 for further increasing the rigidity. A ribbing (compare rib 32 in FIG. 5) of the inside wall 3 increases the rigidity also.

It is also possible to explain the realization of openings 30, 31 with reference to FIG. 6. The bicycle crash helmet 1 consists of two walls 2, 3 that—as already mentioned—are manufactured from a tube using the blowing process. After the blowing process but prior to unmolding, the tube walls 2, 3 are pressed against each other over partial areas 22, 23, 24 so that they adhere to each other there. The areas 22, 23, or 24 that adhere to each other are then cut out along the cutting lines 10 (indicated by slash-dotted line).

The edges surrounding these areas 22, 23, or 24 are formed by the two parts of the walls 2, 3 that adhere to each other there, forming a seal. Hereby openings 30, 31 or air passage openings are created, through which the external air is able to reach the top of the user's head.

At the same time, the wall sections 2', 3' (see FIG. 7) formed hereby result in a reinforcement of the helmet, since these sections form an angle with the otherwise "smooth" outside surfaces 8, 9 of the helmet and in this way are able to largely absorb the impact energy acting e.g. in the direction of arrows 38, 39 (see FIG. 7) on the helmet 1 during a fall.

Said angle may have different values, as shown in the further embodiments.

Figure 8:
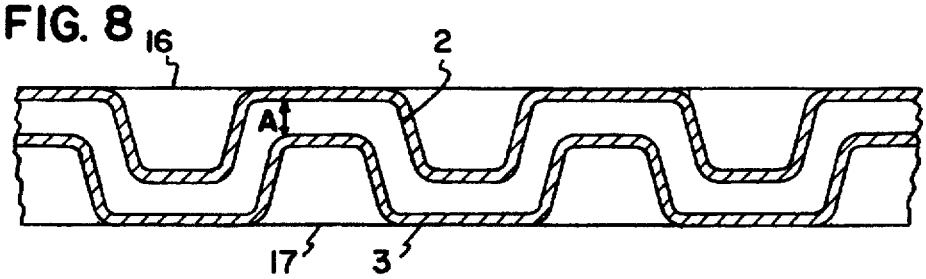
Figure 9:
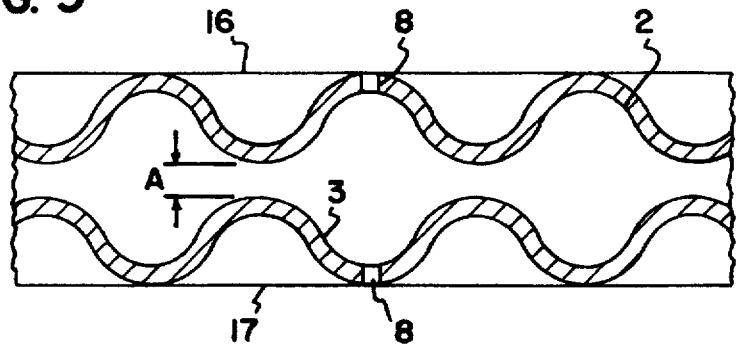
Figure 10:
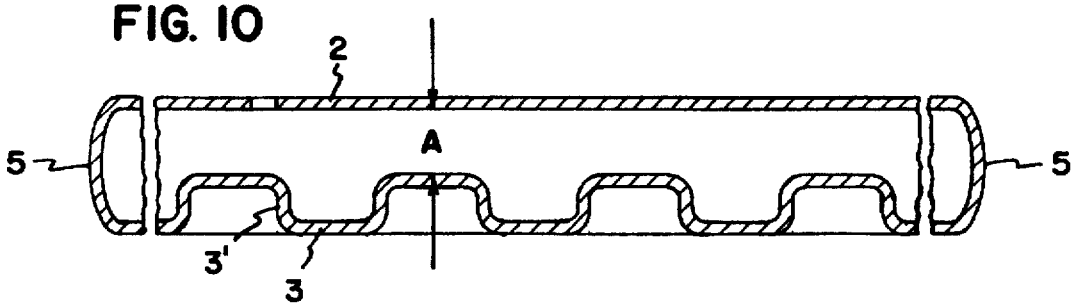

It may also change with the progression of the sections (cf. the wave shapes in FIGS. 8–10).

Figure 7:
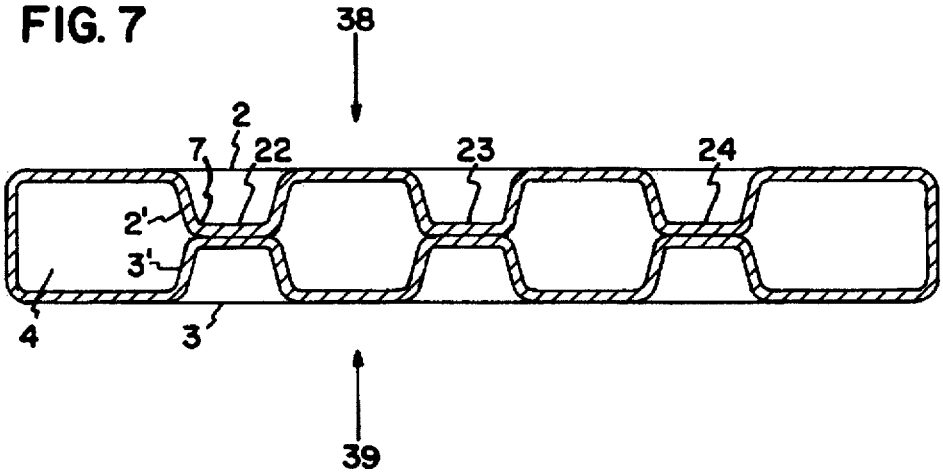
FIGS. 7–10 are detailed sectional views of various embodiments of reinforcements of the helmet walls.

The cross-section in FIG. 7 shows that each of these wall sections 2', 3' extends in the direction towards and again away from the respective other wall 2, 3. This results in a honeycomb structure that however, as shown in FIG. 6, does not extend over the entire area of the helmet 1, but only over the partial areas where said impact resistance must be present.

FIG. 8 shows a section, approximately along 8—8 in FIG. 6, of the two walls 2, 3 in wave shape, whereby the waves run approximately parallel or "synchronously" to each other. Here also the contours 16, 17 of the "smooth" outside surfaces of the helmet 1 are suggested again.

In a corresponding section, FIG. 9 shows the two walls 2, 3, also in wave shape, but whereby the waves of walls 2,3 are directed in opposite direction to each other, or are non-"synchronous". The contours are also suggested here by reference numbers 16, 17.

The concept of this design of the invention, i.e., to extend the walls (see FIGS. 7–9) or at least one wall (see FIG. 10) of the helmet 1 towards the other wall and back again in order to achieve a corresponding reinforcement of the helmet need not be present over the entire helmet area. It is sufficient that it is present in those helmet areas that are at all at risk in the case of a fall.

The embodiment according to FIG. 10 shows that the outside wall 2 is not guided towards the other wall 3 and back again, but extends smoothly, so that only the preferred inside wall 3 is passed towards the outside wall 2 and back again for reinforcement purposes, as is illustrated by sections 3' of inside wall 3 in FIG. 10. The smoothness of the outside wall 2 in this embodiment provides the helmet 1 with a particularly pleasing appearance, while the inside wall 3 ensures the desired rigidity and absorption of the impact energy in case of a fall.

The embodiments of FIGS. 8–10 show that the two walls 2, 3 still have a distance A from each other, thus facilitating the manufacturing using the blowing process. But it should be understood that the walls merge at the side edges or front ends 5 according to the illustration in the example of FIG. 10.

The bores 8 in the example in FIG. 9 illustrate that it is also possible in the case of these designs to ensure that the inside air is able to escape during a fall. According to the illustration in the embodiment of FIG. 10 it is also possible to cover the air outlet opening with a valve of an elastic flap 9, whereby the flap 9 provides a certain resistance to the air escaping through the opening 8'. In principle, other valves are also usable. It is understood that said air outlet means also may be provided in other embodiments.

Figure 11:
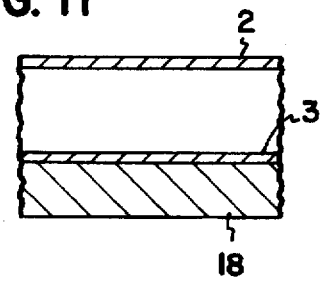
FIG. 11 is a section of the helmet walls with additional plastic layer.

FIG. 11 shows that one or more cushions 18 of a viscoelastic foam may be provided inside the helmet as impact protection. Such a foam has a particularly good shock-absorbing effect. The special advantage of this foam is that it is viscoelastic, i.e., is able to adapt to the shape of the head along the inside curve of the helmet 1 and maintains this adapted shape even if the helmet is removed from the head. This is more advantageous than an inside lining of an elastic foam material, since in the latter case the user must be offered several helmets with different thickness of layers of such an elastic foam material for selection.

Figure 12:
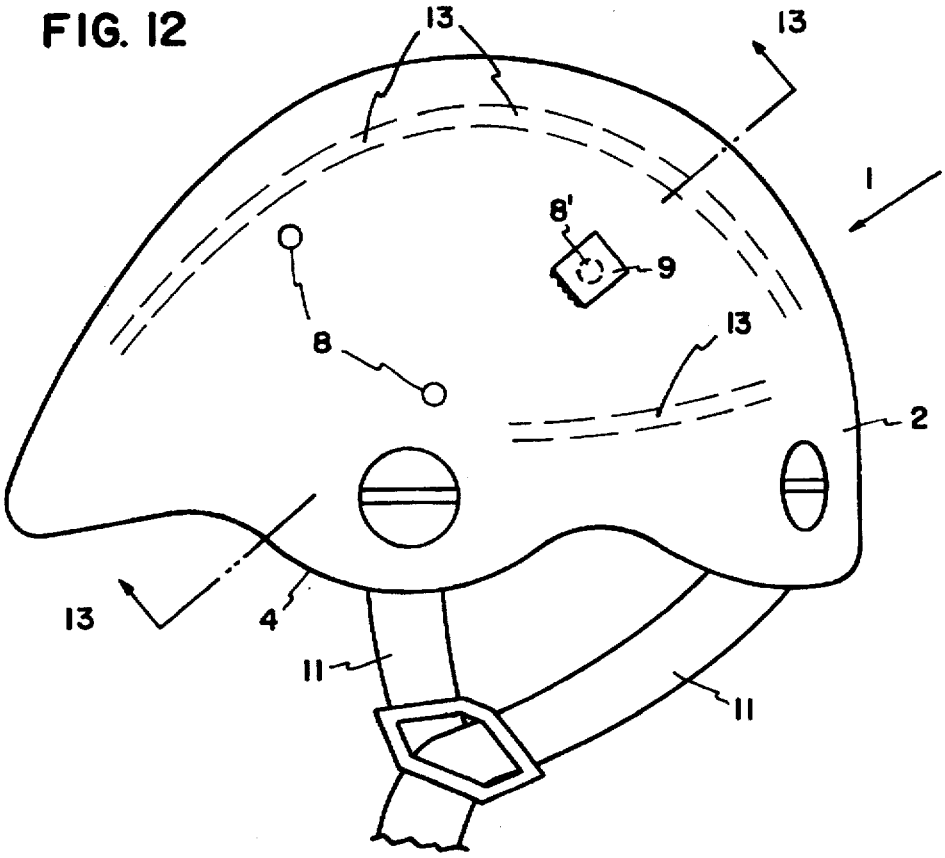
FIG. 12 is a side elevational view of another design of the bicycle crash helmet according to the invention.
Figure 13:
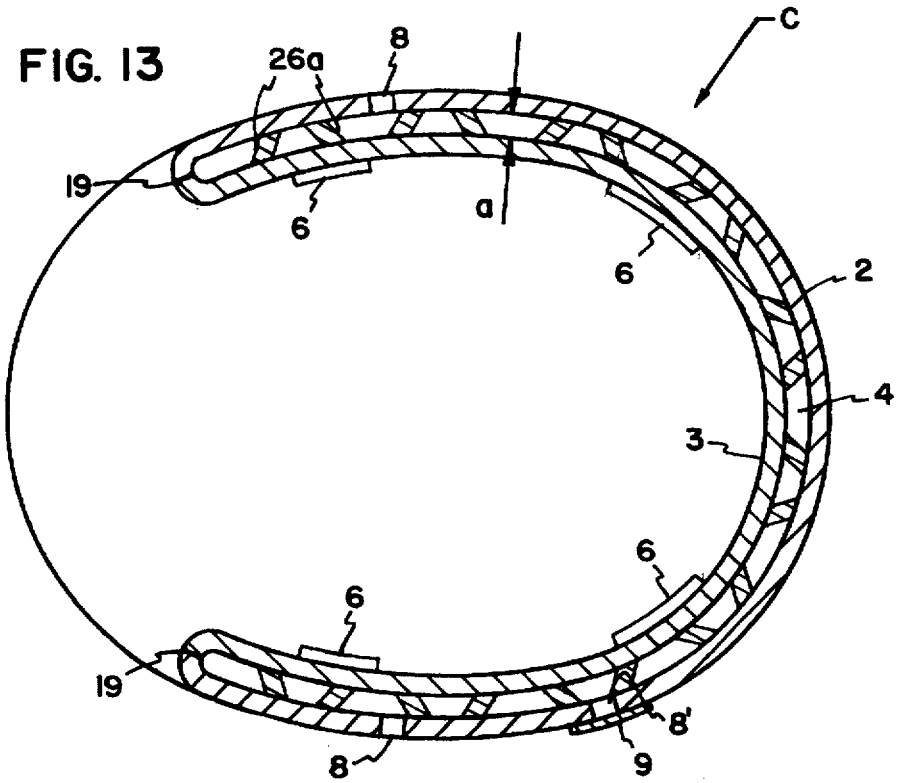
FIG. 13 is a section according to line 13—13 of FIG. 12 with another possible design for producing a reinforcement.

The design of helmet 1 according to FIGS. 12 and 13 is characterized in that the helmet parts forming the walls 2,3 are manufactured from synthetic plastic material as separate shells and are then connected to each other at their edges 19, preferably by welding or adhesion, so that the hollow chamber 4 between them is again closed.

As mentioned, the shell-shaped synthetic parts forming the outside wall 2 and the inside wall 3 may consist of deep-drawn or injected plastic. The walls 2, 3 are manufactured separately and are then connected to each other, e.g. as described above.

Figure 15:
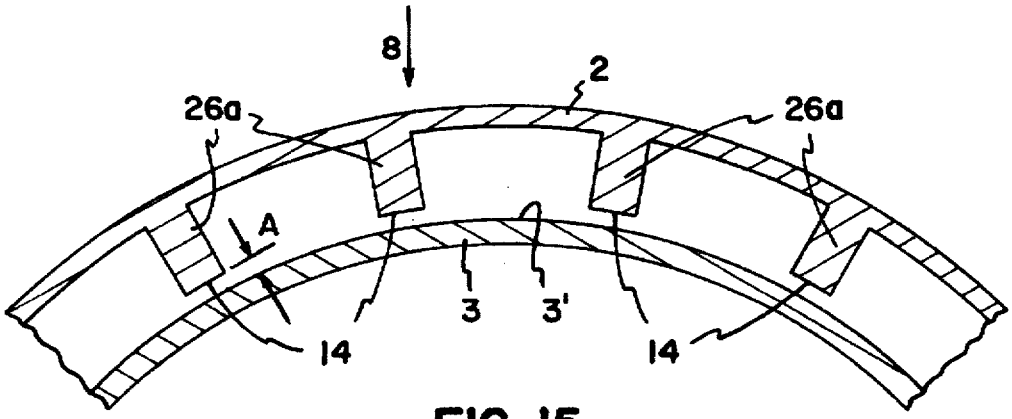

Between the walls 2,3 are reinforcements that may form one part with at least one of the walls 2 or 3 (see FIG. 15).

Figure 14:
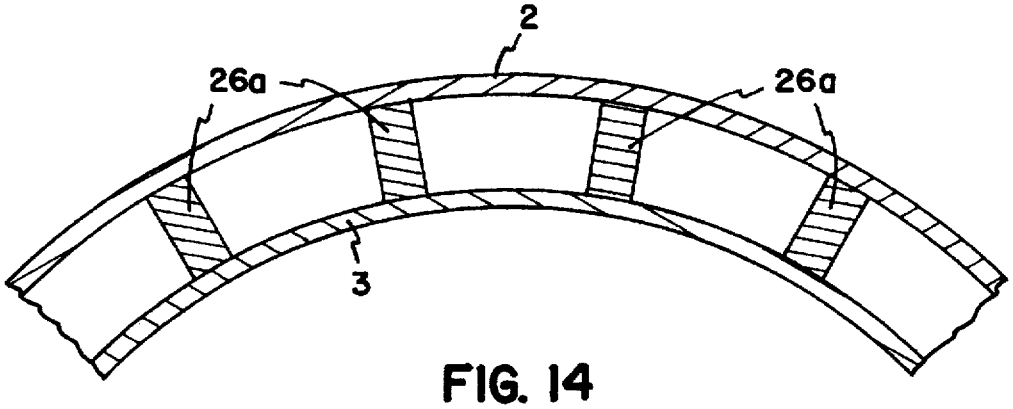
FIGS. 14–16 are partial sections through the helmet, with different possible realizations of the reinforcement at a larger scale.

As an alternative, these reinforcements may be manufactured separated according to FIG. 14 and be connected to one of the walls, e.g. by adhesion. It is recommended that these reinforcements 26*a* are also made of plastic. In the example of FIG. 13, these reinforcements 26*a* or 26*b* form a honeycomb pattern together with helmet walls 2, 3.

Figure 16:
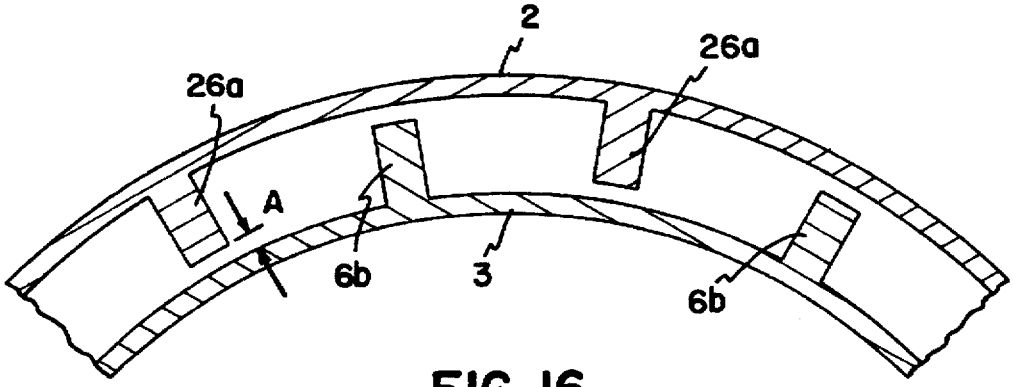

Said reinforcements 26 and also the possible designs of reinforcements illustrated in the examples of FIGS. 14–16 are preferably provided over the entire helmet, but at least in the helmet area that may be stressed by impact energy during a fall, at least as indicated in FIG. 13 by arrow C.

The drawings illustrate that the reinforcements 26*a* extend from one wall 2 or 3 towards the other wall 3 or 2. Hereby it is possible that they progress at an acute angle to said walls (FIG. 13) or at a right angle thereto (FIGS. 14–16).

The connection, e.g. by welding or gluing, of the two helmet walls 2, 3 at their edges 19 closes off the hollow chamber 4 inside these walls in an airtight manner. In the case of a fall, the impact of the helmet results in a compression of the air inside these hollow chambers as additional absorption, and thus the absorption of the corresponding impact energy.

In addition it would also be possible to generate an overpressure of the air inside these hollow chambers of the helmet, either during the manufacturing or preferably via a valve. Especially in the case of a plastic material used for walls 2, 3 this results in greater elasticity due to a corresponding level of overpressure in order to achieve the desired resistance to impact energy, and particularly the absorption of this impact energy.

If the material of the walls 2, 3 is very hard, a possible overpressure in the hollow chambers may be smaller than in the case of a plastic material that is somewhat more resilient. The precondition here is that no air outlet openings or bores exist in walls 2, 3.

But it is also possible to realize the invention with air outlet openings. In addition to the absorption or dampening of the impact energy due to reinforcements 26*a*, 26*b*, an air cushioning may be achieved in such a way that in one of the plastic helmet parts, preferably the outside wall 2, air outlet openings 8 are provided that permit an escape of the air inside the hollow chamber 4 if the two walls 2,3 are compressed due to an impact, but that still exhibit a certain resistance to the air passage. This resistance can be increased if, in the case of a corresponding air outlet opening 8', if there is an additional resistance on the outside, due to a flap 9 of elastic material that is positioned on this opening 8', said flap deflecting the air passage towards the outside. Naturally, a valve may be provided as an alternative.

It should however be emphasized that incorporation of an overpressure and the providing of outlet openings are not absolutely necessary, but represent only a special, additional design.

FIG. 13 also shows absorption strips 6 provided on the inside.

FIG. 15 shows a design with rods 26*a* that are constructed in one piece with one of the helmet walls, here the outside wall 2. In this embodiment, there is a specific, not too large distance A between the corresponding outside end 20—directed towards the other wall 3—of rod 26*a* leading towards the inside surface of helmet wall 3 and the inside surface 3' of helmet wall 3.

The embodiment in FIG. 16 shows that rods 6*a* of wall 2 mesh with rods 6*b* of wall 3 in a comb-like manner and form the reinforcement. It is also possible to provide distances A here—if so desired.

Figure 17:
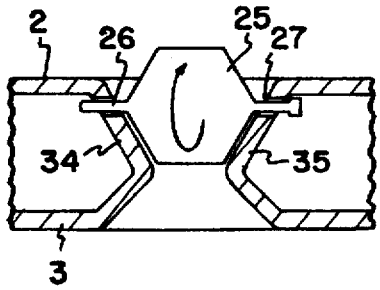
FIG. 17 is another design of the invented helmet that has fan wheels in the area of the break-throughs (cross-section view of the respective partial area)

FIG. 17 shows the arrangement of a fan wheel 25 in the top part of break-through 30 that is positioned rotatably via lateral journals 26, 27 in side walls 34, 35 of break-through 30. During driving, this ensures a suction effect of the warmed air inside the break-through 30.

It is useful that the fan wheel is motor-driven by an appropriate (not shown) drive unit that is driven by a solar cell (also not shown). It is useful that the solar cell is attached laterally on the helmet outside.

Figure 18:
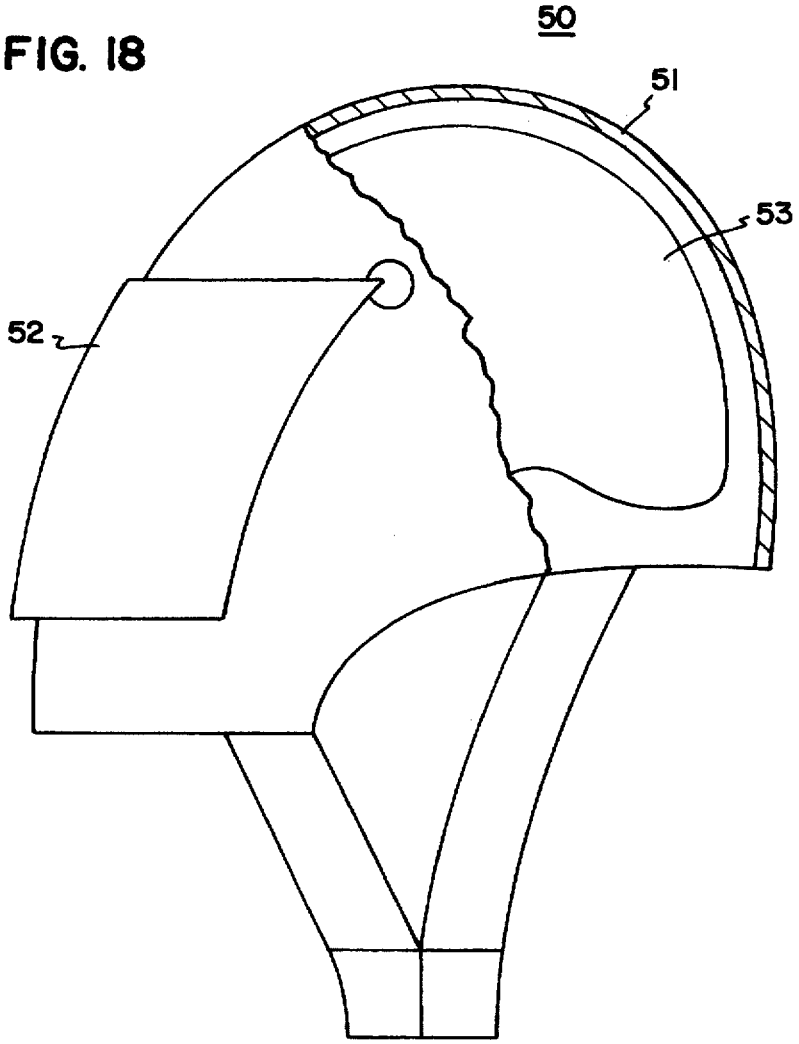
FIG. 18 is a diagrammatic view of a motor cycle crash helmet using the helmet of the invention as a basic structure.

FIG. 18 shows a motorcycle crash helmet 50 that instead of a standard foamed polystyrene basic structure has a basic structure 53 in the form of a helmet of the type described above. It is useful that the basic structure 53 is equipped with the corresponding reinforcement characteristics.

At the outside of the basic structure 53, in rigid connection with it, a helmet shell 51 is provided in FIG. 18 as an integral helmet. The helmet shell consists of an impact- and shock-resistant plastic, e.g. a polycarbonate. A swivel visor 52 is provided in the usual manner at the front of the helmet shell 51.

One advantage is that the two walls 2, 3 of such a helmet may consist of the same recycable plastic, e.g. polystyrene, ABS, polyamide, or polycarbonate. After removing the absorption strips (foam elements) 6 and straps 7, such a bike crash helmet may be disposed off in its entirety.

The preferred material for manufacturing the helmet is polyethylene. Other suitable materials are also polypropylene, copolymer, polystyrene copolymer, acrylbutadiene-styrene, ABS, polyamide, polycarbonate, as well as PET.

The blown plastic material may contain luminescent, fluorescent dyes, color pigments. Because of this, the helmet, after having ben exposed to light, emits light so as to be more easily seen in the dark. It is also possible that the plastic material for the helmet contains special odorous substances for ensuring a special marketing gag for children's bicycle crash helmets, etc.

It is pointed out that the helmet is not only usable as a bicycle helmet but may be used for very different fields of application.

Wall thickness, elasticity, and hardness of the plastic may be adjusted according to the desired requirements.

All illustrated and described characteristics, as well as their combination with each other, are essential to the invention. Characteristics shown for one embodiment also may be used accordingly in one of the other embodiments.

I claim:

1. A bicycle helmet, comprising:

an integrally molded helmet body having an inner shell and an outer shell, the inner and outer shells being concentrically spaced apart and integrally connected to each other by first shell connecting means disposed proximate an edge portion of the helmet body, the inner and outer shells further being integrally connected by second shell connecting means disposed proximate an intermediate portion of the shells spaced from the edge portion, the second shell connecting means including an annular wall of a through opening contained in the helmet body between the shells, the annular wall including integrally molded converging wall portion and diverging wall portion in a direction from the outer shell to the inner shell, thereby to reinforce the helmet body, the spaced apart inner and outer shells forming an air passageway therebetween, the air passageway being filled with air; and an air outlet being disposed on the helmet body, the air outlet being in fluid communication with the air passageway, the air in the air passageway being dischargeable through the air outlet in case a shock or impact force results in a pressure on the shells.

2. A bicycle helmet as defined in claim 1, wherein the air outlet is an opening disposed on the outer shell.

3. A bicycle helmet as defined in claim 1, wherein the air outlet is an air valve including an opening disposed on the outer shell and a flat, elastic flap attached to an outside surface of the outer shell, the flap covering the opening.

4. A bicycle helmet as defined in claim 1, further including a plurality of strengthening ribs disposed on an inside surface of the inner shell.

5. A bicycle helmet as defined in claim 1, wherein the inner and outer shells and the first and second shell connecting means are formed by blow molding.

6. A bicycle helmet as defined in claim 1, wherein an average thickness of each of the shells is 1.5 to 2.0 mm.

7. A bicycle helmet as defined in claim 1, wherein the shells are made of a synthetic plastic material selected from a group consisting of polyethylene, polypropylene copolymer, polystyrene copolymer, acryl-butadiene-styrene, polyamide, and polycarbonate.

8. A bicycle helmet as defined in claim 7, wherein the synthetic plastic material contains a luminescent material.

9. A bicycle helmet as defined in claim 8, wherein the synthetic plastic material contains a fluorescent dye.

10. A bicycle helmet as defined in claim 8, wherein the synthetic plastic material contains a color pigment.

11. A bicycle helmet, comprising:

an integrally molded helmet body having an inner shell and an outer shell, the inner and outer shells being concentrically spaced apart and integrally connected to each other by first shell connecting means disposed proximate an edge portion of the helmet body, the inner and outer shells further being integrally connected by second shell connecting means disposed proximate an intermediate portion of the shells spaced from the edge portion, the second shell connecting means including an annular wall of a through opening contained in the helmet body between the shells, the annular wall including integrally molded converging wall portion and diverging wall portion in a direction from the outer shell to the inner shell, thereby to reinforce the helmet body, the spaced apart inner and outer shells forming an air passageway therebetween, the air passageway being filled with air;

the inner shell having at least one strengthening rib portion extending away from the air passageway, being disposed proximate an intermediate area of the inner shell, and being distant from and disconnected from the second shell connecting means and from the through opening, the at least one strengthening rib portion being configured to provide additional safety in case that the outer shell is forced in contact with the inner shell; and the outer shell having at least one strengthening rib portion extending into the air passageway and being disposed proximate a side area of the outer shell, and being distant from and disconnected from the second shell connecting means and the through opening, so as to provide the helmet with additional strength.

12. A bicycle helmet as defined in claim 11, wherein the inner and outer shells and the first and second shell connecting means are formed by blow molding.

13. A bicycle helmet as defined in claim 11, wherein an average thickness of each of the shells is 1.5 to 2.0 mm.

14. A bicycle helmet as defined in claim 11, wherein the shells are made of a synthetic plastic material selected from a group consisting of polyethylene, polypropylene copolymer, polystyrene copolymer, acryl-butadiene-styrene, polyamide, and polycarbonate.

15. A bicycle helmet as defined in claim 14, wherein the synthetic plastic material contains a luminescent material.

16. A bicycle helmet as defined in claim 14, wherein the synthetic plastic material contains a fluorescent dye.

17. A bicycle helmet as defined in claim 14, wherein the synthetic plastic material contains a color pigment.

* * * * *